United States Patent [19]

Dahl

[11] Patent Number: 4,949,884

[45] Date of Patent: Aug. 21, 1990

[54] PAINT CAN LID WITH DRIP-FREE POUR SPOUT

[76] Inventor: Gordon T. Dahl, P.O. Box 291, Lakewood, Wash. 98259

[21] Appl. No.: 448,375

[22] Filed: Dec. 11, 1989

[51] Int. Cl.[5] ..... B65D 25/48

[52] U.S. Cl. ..... 222/570; 220/85 SP; 220/306; 222/571

[58] Field of Search ..... 222/192, 566–571; 220/90, 85 SP, 306, 307, 90.2, 90.4, 90.6

[56] References Cited

U.S. PATENT DOCUMENTS

| | | | |
|---|---|---|---|
| 2,442,047 | 5/1948 | Kemper | 222/571 |
| 2,664,230 | 12/1953 | Heim | 222/571 |
| 2,822,965 | 2/1958 | Smith | 222/571 |
| 2,873,052 | 2/1959 | Atherton | 220/90 X |
| 3,102,667 | 9/1963 | Ullevig | 222/90 X |
| 3,221,955 | 12/1965 | Banaszak et al. | 222/570 |
| 3,469,735 | 9/1969 | Burt | 222/90 |
| 4,009,802 | 3/1977 | Hayduchok | 222/570 X |
| 4,020,968 | 5/1977 | Chiavola et al. | 222/570 X |
| 4,034,901 | 7/1977 | Kirk | 222/570 X |
| 4,240,568 | 12/1980 | Pool | 222/570 X |
| 4,299,340 | 11/1981 | Hrytzak | 222/570 X |
| 4,353,489 | 10/1982 | Arnold et al. | 222/570 |
| 4,403,709 | 9/1983 | Meins et al. | 222/570 X |
| 4,579,257 | 4/1986 | Brandlein | 222/570 X |
| 4,865,233 | 9/1989 | Kain | 222/570 |

FOREIGN PATENT DOCUMENTS

| | | | |
|---|---|---|---|
| 939283 | 1/1974 | Canada | 220/85 SP |

*Primary Examiner*—Kevin P. Shaver

*Attorney, Agent, or Firm*—Harry M. Cross, Jr.

[57] ABSTRACT

A paint can lid comprising a one-piece molded plastic lid. The periphery of the lid is formed to provide an outer edge that will engage the underside of a paint can rim, engage and extend up along the outer, vertical edge of the paint can rim, and extend inwardly along the top of the paint can rim. Inward of the lid periphery, the lid is formed with a downwardly-extending annular cavity defined by the lid wall having a U-shaped cross section. Immediately inward of the annular cavity, the lid is formed to provide a pouring spout of frusto-conical configuration having a truncated top. The top of the spout is provided with a peripheral rim enclosing a pouring opening of a diameter smaller than the diameter of the spout top itself.

4 Claims, 1 Drawing Sheet

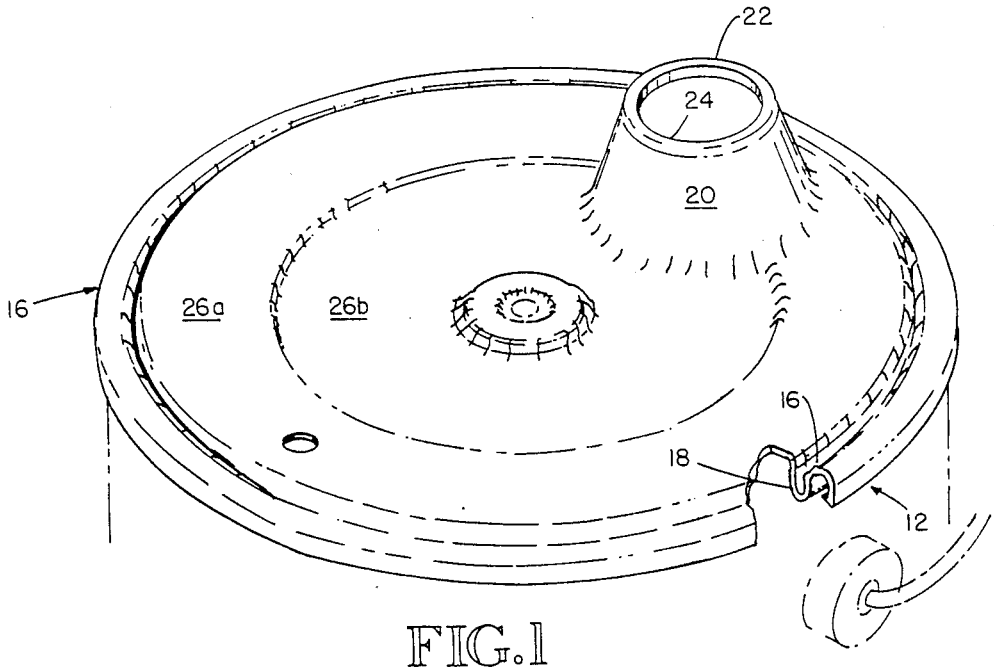
FIG. 1
FIG. 2
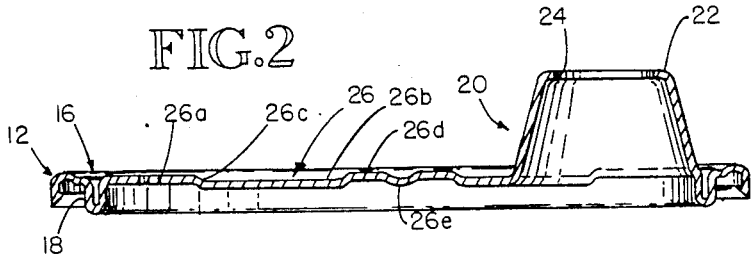
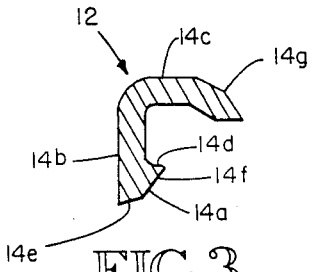
FIG. 3
FIG. 4
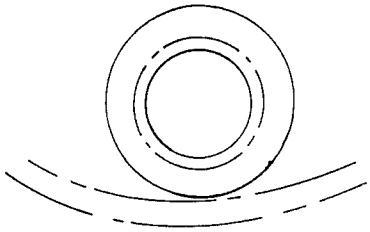

PAINT CAN LID WITH DRIP-FREE POUR SPOUT

FIELD OF THE INVENTION

This invention pertains to lids for paint cans, and particularly to lids of the type having a pouring spout associated therewith

BACKGROUND OF THE INVENTION

Although paint can lids having pouring spouts have been proposed in the past, such lids have either not been simple to manufacture, easy to apply or remove from a paint can, or convenient to use. The aim of the present invention is to provide a reusable paint can lid, having a paint pouring spout, that can be inexpensively produced and that can be securely fastened to the opening of a paint can. Another aim is to provide such a lid that can also be removed easily so that the paint can's original lid can be re-installed on the paint can.

SUMMARY OF THE INVENTION

The paint can lid of the present invention is a one-piece molded plastic lid. The periphery of the lid is formed to provide an outer edge that will engage the underside of a paint can rim, engage and extend up along the outer, vertical edge of the paint can rim, and extend inwardly along the top of the paint can rim. Inward of the lid periphery, the lid is formed with a downwardly-extending annular cavity defined by a the lid wall having a U-shaped cross section. Immediately inward of the annular cavity, the lid is formed to provide a pouring spout of frusto-conical configuration having a truncated top. The top of the spout is provided with a peripheral rim enclosing a pouring opening of a diameter smaller than the diameter of the spout top itself.

BRIEF DESCRIPTION OF THE DRAWINGS

FIG. 1 shows the paint can lid of this invention is perspective as it would appear placed of a paint can shown in dotted line, a portion of the lid being cut away to reveal the corss-sectional configuration of the lid periphery;

FIG. 2 is a cross section view of the FIG. 1 lid;

FIG. 3 is an enlarged view of the periphery of the FIG. 1 lid; and

FIG. 4 is an end view of the tapered spout.

DETAILED DESCRIPTION OF THE INVENTION

The lid of this invention is designed to fit a typical one gallon paint can that has a top opening bounded by a rim formed with a depressed annular groove and an outer, vertically-depending edge, the edge having an undercut surface extending inward toward the side of the paint can.

The paint can lid 10 of the present invention is a one-piece molded plastic lid having a typical wall thickness of 0.06 inches. The periphery 12 of the lid is formed to provide an outer edge that will have a section **14*a* to engage the underside of a paint can rim, a section 14*b* to engage and extend up along the outer, vertical edge of the paint can rim, and a section 14*c* to extend inwardly along the top of the paint can rim. Inward of the lid periphery, the lid is formed with a downwardly-extending annular cavity 16 defined by the lid wall having a U-shaped cross section 18. Immediately inward of the annular cavity, the lid is formed to provide a pouring spout 20 of frusto-conical configuration having a truncated top 22. The top of the spout is provided with a peripheral rim 24 enclosing a pouring opening of a diameter smaller than the diameter of the spout top 22** itself.

The lid outer edge 12 is provided with an inwardly-extended annular lip **14*d* that will engage the undercut edge of a paint can rim when the lid is applied to the paint can. This lip 14*d* slopes inward and downward at a small acute angle of about 10 degrees. This small acute angle enables the lid to be fitted to the paint can rim edge more easily and to be removed more easily. The lid outer edge section 14*a*, that includes lip 14*d*, is itself formed with a bottom outer annular edge 14*e* that slopes inward and upward at a small acute angle with respect to the horizontal of about 15 degrees, and a bottom inner annular edge 14*f* that extends inward from the outer edge 14*e* and upward at larger angle with respect to the horizontal of about 50 degrees. Inner edge 14*f* intersects lip 14*d* at an acute angle of about 60 degrees. These particular relationships of the sections that make up the edge 12** provide strength to the edge that enables it to be fitted to a paint can rim without chipping or breaking as the lid is applied and removed from the paint can.

The edge section **14*c* extends inwardly into a transition section 14*g* between the edge 12 and the U-shaped wall section 18. This transition section 14*g* slopes downward at at acute angle from the horizontal to the point of intersection with the U-shaped wall section 18. This sloping transition section 14*g* permits the lid to be applied to a paint can opening, the U-shaped wall section 18 forced into the paint can annular peripheral groove, and the lid edge 12 pressed downward and against the paint can rim until the lip 14*d* snaps into place underneath the paint can rim. The transition section 14*g* functions as an annular hinge permitting the necessary movements to take place that effect locking of the lid to the paint can rim. The slope of the transition section 14*g* gives the edge 12** flexibility that it would not otherwise have.

The top surface 26 of the lid is provided with a flat annular raised section **26*a* adjoining the inner edge of U-shaped wall section 18, and, inwardly of raised section 26*a*, a flat depressed section 26*b* that occupies most of the center area of the lid top surface 26. This configuration provides another transition section 26*c*, this one between sections 26*a* and 26*b*, that constitutes a stiffening ring between the center of the lid and the U-shaped wall section 18. At the center of the top surface 26, another raised section 26*d* may be provided with a center-point depressed dimple 26*e* therein. As can be seen in FIG. 2, the edge section 14*c* is positioned above the plane of top surface sections 26*a* and 26*d*, and edge section 14*a* is positioned between the bottom of U-shaped wall 18 and the plane of top surface section 26*b***.

Pouring spout 20 rises out of the top surface 26 at a location where the ring **26*c* intersects the base of the spout as shown in FIGS. 1 and 2. Consequently, the inner half of the spout base is located on the depressed top surface section 26*b* and the outer half of the spout base is located on the raised top surface section 26*a*. The outer surface of the spout 20, at its most radially-outward point, coincides with the adjacent inner surface of the annulus 16 and the inner surface of the spout 20, at the same point, coincides with the inner surface of the U-shaped wall section 18 as shown in FIG. 2. The upper rim 24 of spout 20 is straight-edged and therefore, being located inward of the spout top 22, provides a drip-proof configuration. When paint-pouring is terminated, the edge of the rim 24 acts as a knife-edged weir that cuts off paint discharge without dripping. The spout has a wall slope of about 15 degrees with respect to the vertical. The spout top has a diameter of about 1.250 inches and the inner diameter of the pouring opening, bounded by rim 24**, is about 1 inch.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A paint can lid comprising a one-piece molded article having a generally flat top surface; a pouring spout rising from the top surface; a periphery for gripping the peripheral edge of a paint can comprising an outer edge having a first section to engage the underside of a paint can rim, a second section to engage and extend up along the outer vertical edge of a paint can rim, and a third section to extend inwardly along the top of the paint can rim; a downwardly-extending annular cavity postioned inward of the lid periphery and defined by the lid wall having a U-shaped cross section; the pouring spout being of frustro conical configuration having a truncated top, the top of the spout being provided with a peripheral rim enclosing a pouring opening of a diameter smaller than the diameter of the spout top itself; the first section having an inwardly-extended annular lip for engagement with an undercut edge of a paint can rim when the lid is applied to the paint can, the lip sloping inward and downward at a small acute angle; and an annular transition section between the third section of the outer edge and the U-shaped wall section, the transition section sloping downward at at acute angle from the horizontal to the point of intersection with the U-shaped wall section, the transition section functioning as an annular hinge to permit the lid to be applied to a paint can opening and locked in place, whereby the necessary movements to take place that effect locking of the lid to the paint can rim can occur.

2. The paint can lid of claim 1 wherein the top surface of the lid is provided with a flat annular raised section adjoining the inner edge of the U-shaped wall section, and, inwardly of this raised section, a flat depressed section that occupies most of the center area of the lid top surface whereby is provided a transition section in the form of a stiffening ring between the center of the lid and the U-shaped wall section.

3. The paint can lid of claim 2 wherein the pouring spout rises out of the top surface at a location where the stiffening ring intersects the base of the spout whereby the inner half of the spout base is located on the depressed top surface section and the outer half of the spout base is located on the raised top surface section.

4. The paint can lid of claim 1 wherein the rim of the spout is vertically straight-edged which, being located inward of the spout top, provides a drip-proof configuration whereby the edge of the rim acts as a knife-edged weir that cuts off paint discharge without dripping when pouring is terminated.

* * * * *